US008257523B1

(12) United States Patent
Puszynski et al.

(10) Patent No.: US 8,257,523 B1
(45) Date of Patent: Sep. 4, 2012

(54) ALUMINUM-BASED NANOTHERMITES AND PROCESSES OF MAKING THE SAME

(75) Inventors: Jan A. Puszynski, Rapid City, SD (US); Jacek J. Swiatkiewicz, Rapid City, SD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 97 days.

(21) Appl. No.: 12/750,405

(22) Filed: Mar. 30, 2010

(51) Int. Cl.

| | |
|---|---|
| ***C06B 45/00*** | (2006.01) |
| ***C06B 45/04*** | (2006.01) |
| ***C06B 33/00*** | (2006.01) |
| ***D03D 23/00*** | (2006.01) |
| ***D03D 43/00*** | (2006.01) |

(52) U.S. Cl. ..... 149/109.6; 149/2; 149/17; 149/37; 149/108.2; 149/109.2

(58) Field of Classification Search ..... 149/17, 149/2, 37, 108.2, 109.2
See application file for complete search history.

(56) References Cited

U.S. PATENT DOCUMENTS

2006/0113014 A1* 6/2006 Puszynski et al. ..... 149/40
2009/0301337 A1* 12/2009 Wilson et al. ..... 102/364
* cited by examiner

*Primary Examiner* — James McDonough
(74) *Attorney, Agent, or Firm* — Charlene A. Haley

(57) ABSTRACT

An apparatus and process for making thermite compositions. The process includes providing a fuel-based slurry and at least one oxidizer-based slurry, formulating combination of fuel-based slurry and oxidizer-based slurry in a solvent to a desired energetic dose depending on nanocomposites' use, circulating the fuel-based slurry/oxidizer-based slurry combination in a mixing device operating semi-continuously during mixing and dispensing cycles forming a homogeneous mixed slurry, agitating ultrasonically or by high shear rate mixers the mixed slurry, and drying of the mixed slurry forming compact structures.

14 Claims, 22 Drawing Sheets

ALUMINUM-BASED NANOTHERMITES AND PROCESSES OF MAKING THE SAME

STATEMENT REGARDING FEDERALLY SPONSORED RESEARCH OR DEVELOPMENT

The invention described herein may be manufactured and used by or for the government of the United States of America without the payment of any royalties thereon or therefor under Contract N68936-08-C-0046.

FIELD OF THE INVENTION

The invention generally relates to nanosized solid thermite reactants and their safe mixing processes, and more specifically, processes that permits, the flexibility of mixing various components, use of solvents, and the potential to yield larger quantities of products.

Figure 1:
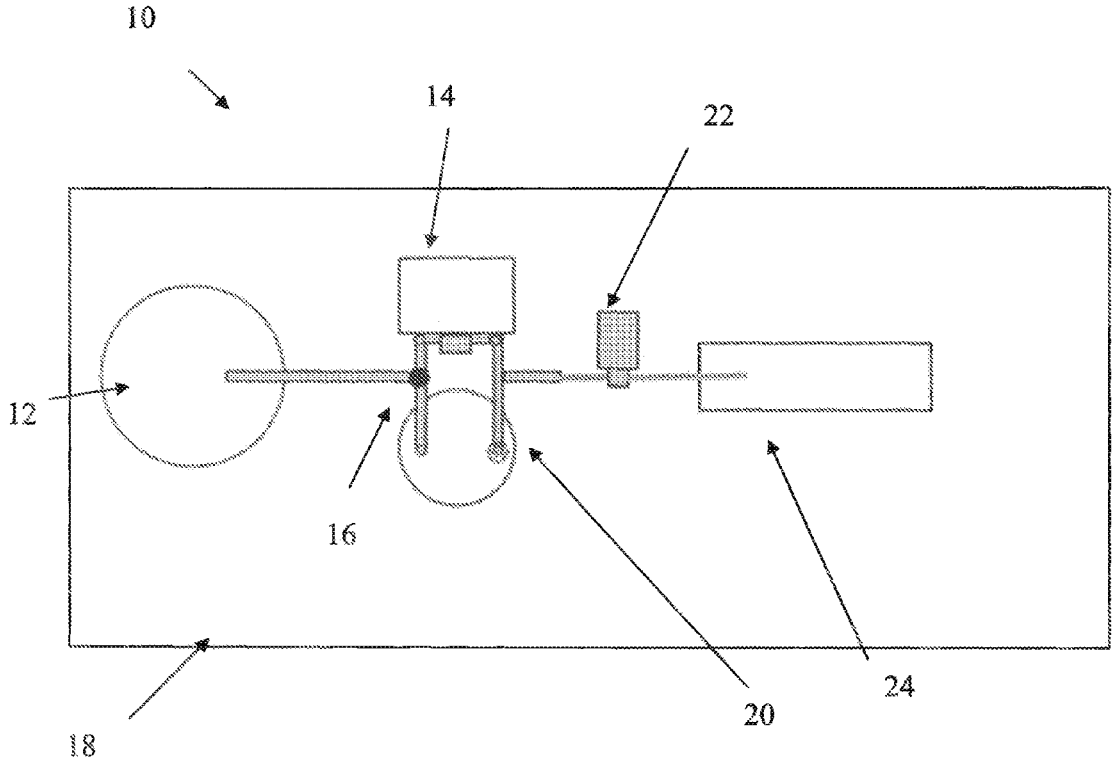
FIG. 1 is a schematic layout of pre-mixing, in-line mixing and dosing reservoir and piping, according to embodiments of the invention.

It is to be understood that the foregoing general description and the following detailed description are exemplary and explanatory only and are not to be viewed as being restrictive of the invention, as claimed. Further advantages of this invention will be apparent after a review of the following detailed description of the disclosed embodiments, which are illustrated schematically in the accompanying drawings and in the appended claims.

DETAILED DESCRIPTION OF THE EMBODIMENTS OF THE INVENTION

Embodiments of the invention generally relate to a process of making thermite composites, including, providing a fuel-based slurry and at least one oxidizer-based slurry, formulating combination of fuel-based slurry and oxidizer-based slurry in a solvent to a desired energetic dose depending on said nanocomposites' use, circulating the fuel-based slurry/oxidizer-based slurry combination in a mixing device operating semi-continuously during mixing and dispensing cycles forming a homogeneous mixed slurry, agitating ultrasonically or by high shear rate mixers said mixed slurry, and drying of the mixed slurry forming compact structures.

Other embodiments relate to a circulating mixer including, an in-line mixer combined with an ultrasound agitator/bath, at least one tubing, metering pump, peristaltic pump, mixing pump, and valve configured in the in-line mixer to aid in mixing and metering of at least one slurry mixture in solvent(s) and reduce any dead volume in mixer, tubing or valve. In embodiments, the pump includes a variable speed tubing pump.

In embodiments of the invention, the mixing process can be a water-based mixing process. In other embodiments, the step of forming compact structures includes forming pellets or granules. Other embodiments wherein the step of formulating combination of fuel-based slurry and oxidizer-based slurry to desired energetic dose depending on the nanocomposites' use comprises dosing the slurry combination to produce energetic nanocomposites for one of the applications is selected from the group consisting of primer cups, coatings, percussion primers, electric primers, and low energy initiators. While in other embodiments, the step of continuous mixing utilizes an in-line mixer is capable of recirculation of said desired slurry formulation.

In embodiments, at least one fuel-oxidizer-based slurry which includes, but is not limited to, a metal and/or metal alloy. In embodiments, the metal and/or metal alloy includes, but is not limited to, Al or Al-metal. In other embodiments, at least one fuel-oxidizer-based slurry includes, but is not limited to, at least one of Al—$Fe_2O_3$, Al—$Bi_2O_3$, Al—$MoO_3$, Al—$WO_3$, Al—CuO, Al—$Bi_2O_3/Fe_2O_3$, Al—$Fe_2O_3/SiO_2$, and any combination thereof. Other embodiments, further include the step of mixing said oxidizer-based slurry in a least one solvent. Wherein the solvents include, but are not limited to water or anhydrous solvents from the group consisting of hexane, acetone, and isopropyl alcohol, and any combination thereof.

In embodiments, the process further included the step of mixing a second oxidizer-based slurry to the oxidizer-based slurry/solvent. Embodiments further included steps of circulating the fuel-based slurry/oxidizer-based slurry combination in a mixing device operating continuously during mixing and dispensing cycles resulting in a mixed slurry; and agitating ultrasonically mixed slurry can be simultaneously for a specified time depending on desired utility. Embodiments of the invention have composites including nanosized particles being in the form of nanopowders and/or nanoflakes. In other embodiments, the slurry mixture further includes the step of adding a binder. Yet in other embodiments, the process further includes at least one energetic additive. Another embodiment claims the nanothermites produced by the processes described in detailed description.

Some of the objects to test included: 1) Demonstrating a continuous process of mixing of the Al—$Bi_2O$, nanothennite in water using a micro-mixer system; 2) Developing the forming and a controlled drying process of the nanothermite granules and test a safe storage of the Al—$Bi_2O$, granules; 3) Demonstrating use of the micro-mixers and water-based loading process for other energetic nanothermites like Al—$Fe_2O_3$; and 4) Demonstrating use of the micro-mixers for preparation of Al—$MoO_3$, in anhydrous solvents.

The following actions were initiated: defining basic concepts of the process construct; making choice of the hardware components; and testing of major performance indicators of the hardware. One of the objectives of the invention focused on making of the metastable interstitial composite (MIC) granules. This objective includes forming a dense MIC slurry into separated droplets of controlled equal volume. It was estimated that volume of the MIC droplet which can be easily handled in the range of about 3 μL to about 8 μL. Considering that practical frequency of the droplet deposition is about 2 per second the volume of MIC mixture used in one minute would be 0.96 mL. Using this volume rate (flux) for yield estimation, the apparatus and method could make about 660 g of dry MIC (57600 granules) using 460 mL of MIC suspension in water during 8 hrs of continuous work.

Nanopowder components of MIC should be thoroughly mixed in liquid in order to obtain the desired rheological properties of dense slurry and expected energetic properties of MIC after drying. Limiting current considerations to the water-based suspensions the mixing process was divided into two steps: a) pre-mixing of aluminum and oxide nanopowders, and b) high flow rate mixing in the in-line mixer with or without ultrasonic radial agitation. Both mixing stages should work in a cyclic regime for specified period of time, for example, 15 minutes. Volume of MIC mixture metered for drying during a 15 minute cycle is about 15 mL, therefore a reservoir including a mixed homogeneous MIC suspension, ready for dispensing, should accommodate suspension volume changes of ±15 mL. In other embodiments, the mixer and pre-mixer should also do the same.

Figure 22:
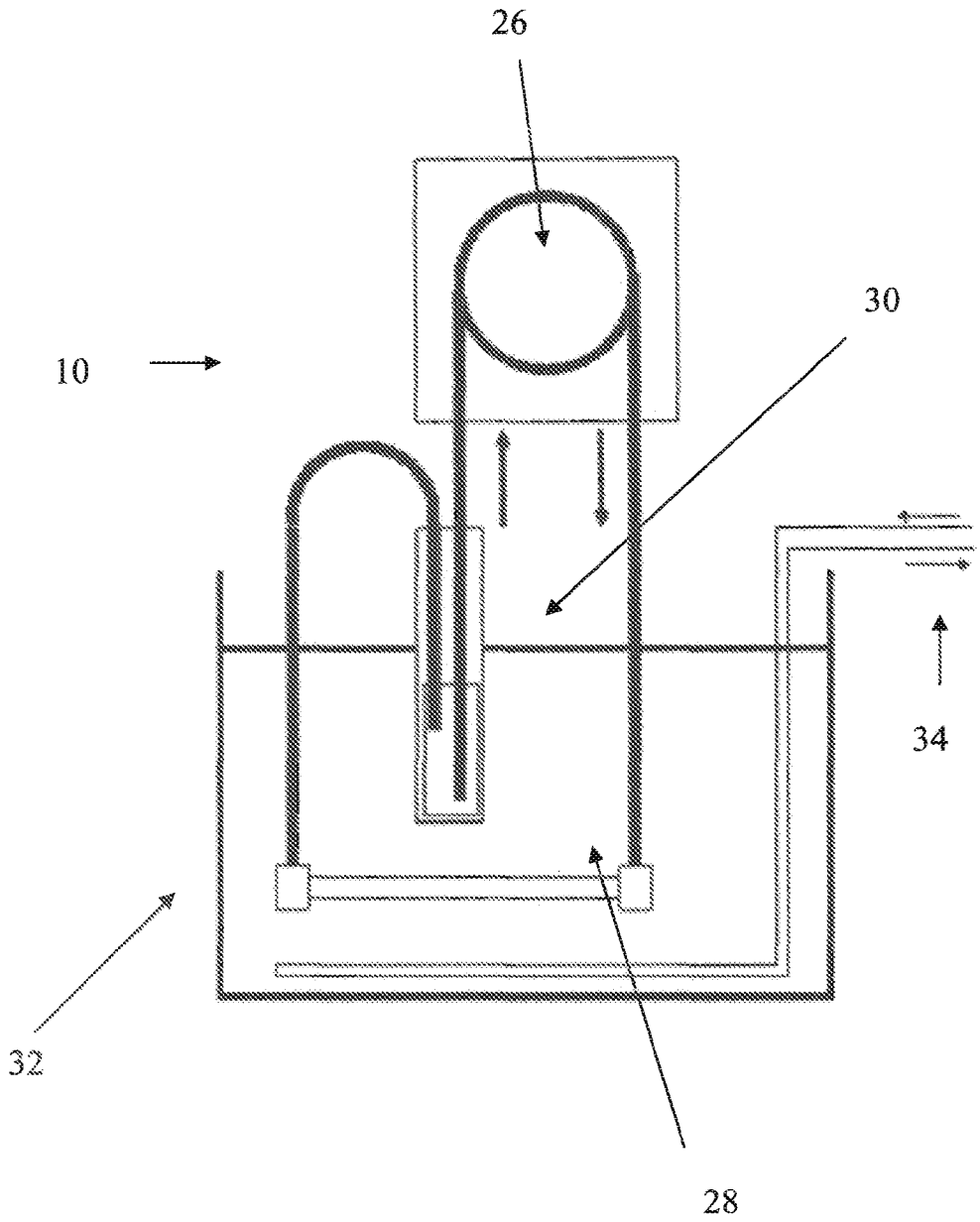
FIG. 22 is a schematic of mixing apparatus according to embodiments of the invention.

The other major concerns in the construct of the apparatus and method of its use were issues of reduction of the "dead volume" of pumps, valves, and tubing, and minimization of complexity of the pump for easy cleaning and possible need of part replacement. The pump chosen for mixing must also have wide control of volume flow. In an embodiment, the mixing pump chosen was a variable speed tubing pump. There are wide choices of tubing suitable for various chemical environments of the tubing sizes and strength. Tubing pumps usually do not work at higher than 100 psi pressures and in most general application they are used below 25 psi. A tubing pump with standard L/S-16 Tygon tubes (⅛" OD) was tested in a setup with an attached tube in-line mixer. The in-line mixer included 27 helical sections and was housed in a stainless steel tube (3/16" OD) and the mixer was purchased from Cole Palmer (catalog #04669-54). The pump (Cole-Palmer, Masterflex head and driver, models 7520-40 and 7518-10, respectively) can force a flow of 480 ml/min at maximum driver speed of 600 rpm. In the initial experiment water was circulated in an external container, and then water was replaced by an alumina suspension. Embodiments of the invention 10 as shown in FIG. 22, 26 includes the peristaltic pump, arrow indicate direction of slurry flow, 28 is the in-line mixer, 30 is the slurry reservoir (volume ~30 mL), 32 is the ultrasonic bath, 34 is the heat exchanger, arrows indicate cooling water flow direction.

A pressure gauge was installed before the inlet to the in-line mixer to observe a buildup of the pressure during circulation of liquid. At maximum flow of 480 ml/min of water, the pressure drop on the in-line mixer was below 5 psi. The pressure drop increased when 37.5 wt % alumina slurry circulated in the same closed system. By adjustment of rotor speed and suspension flow to about 240 ml/min, the pressure was kept constant at 15 psi. After less than 10 minutes of circulation through the in-line mixer the alumina suspension become homogeneous and stable. It was concluded that tubing pumps are sufficient to pump dense slurry with high flow rate (240 ml/min) through the in-line mixer without extensive pressure increase. Therefore, it was decided that the tubing pumps (peristaltic pumps) will be used in this embodiment segments where mixing of slurry will be carried out.

Mixing and metering system, shown in FIG. 1, allowed testing of some components in embodiments of the invention, including, but not limited to, solenoid valves 16, pumps, in-line mixers 20, metering pump 22, deposition plate 24, and tubing pump 14. FIG. 1 is a schematic layout of pre-mixing, in-line mixing and dosing reservoir and piping. Mixer should include up to 45 mL of MIC slurry and will dispose about 5 mL every 15 minutes.

In this embodiment 10, all unit processes, like premixing of MIC components, in-line mixing of nanothermite suspension 12 or disposing of suspension droplets were initially optimized. However, this system could deliver the product only periodically in cycles lasting about 15 minutes. The main advantage was that the volume of the material in one cycle was minimized to a content of one mixing container 18 (possibly continuous process may need three such containers); therefore, optimization of the process was safer and involved less material, which had to be deactivated after each test for safety reasons.

Setups for Testing In-Line Mixer Pressure Drop.

Components for testing in-line mixer pressure drop were purchased from Cole-Palmer. The testing part of the embodiments include of a tube in-line mixer (EW-04669-54) connected with a ⅛" barb T-connector to a pressure sensor (Honeywell, 40PC015G), and a precise neoprene tubing L/S 16 (EW-06404-16), crossing the Masterflex L/S Easy-Load II pump head (EW-77200-60). The tubing pump head was attached to a Masterflex L/S brushless variable speed digital drive (EW-07523-60) allowing for changing flow rate within 10 to 480 ml/min range. The Masterflex tubing pump can be set at any flow rate before or during the experiment with accuracy of 1 mL/min regardless of the resistance to the flow; however, pressure should not exceed the pressure rating specified for the tubes (below 25 PSI in our case). Connections of stainless steel tubes (3/16" diameter) to the flexible neoprene tubes were secured with adjustable plastic collars. Typical volume of the tubing was about 8-11 mL.

The in-line mixer was made of the 316 stainless steel and has a 3/16" outer diameter and includes 27 mixing elements. During a flow through the mixer, fluid is redirected by mixing elements and experiences flow resistance. The resulting pressure drop across the mixer depends on viscosity, specific gravity of the suspension and the flow rate. Tested suspension was prepared in a container (beaker) and during experiment was re-circulated. Pressure was measured at the entrance to the in-line mixer; the output from the mixer was directed to the open container and, it was assumed that there is no significant pressure drop in this last section of the device. In order to secure pressure sensor against contamination with the slurry, the sensor was connected using 3 ft long, thick wall tube. A pressure transducer signal was internally corrected for temperature changes and amplified so it could be detected directly with a 16 bit A/D card and recorded in the PC.

Figure 2:
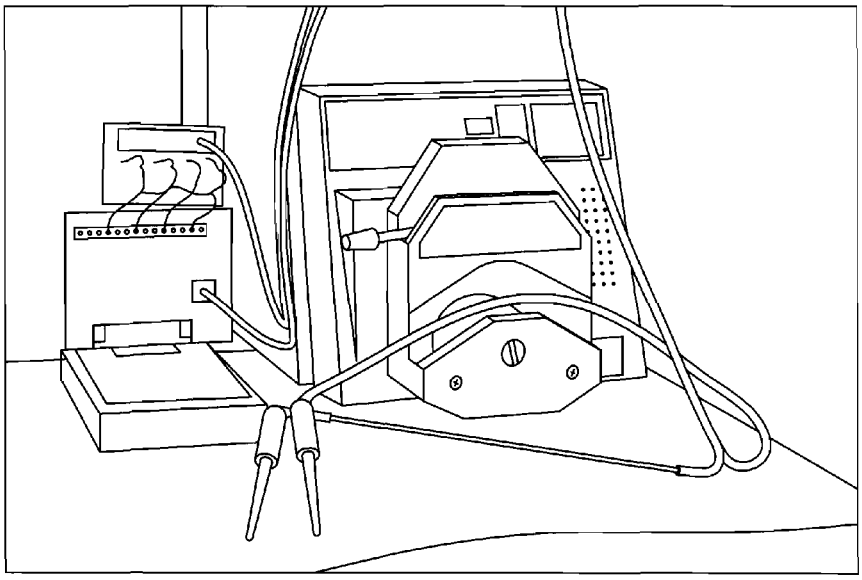
FIG. 2 is a photograph of an assembled in-line mixer (6' long SS tube) with a neoprene tube (black) passing across the pump head. In front, two short SS tubes were used to intake suspension from a container and to output mixed slurry back to the container, according to embodiments of the invention.

An overview of the assembled components in another embodiment is shown in FIG. 2. FIG. 2 is a photograph of an assembled in-line mixer (6' long SS tube) with a neoprene tube (black) passing across the pump head. In front, two short SS tubes were used to intake suspension from a container and to output mixed slurry back to the container. A multi-channel A/D external card (PicoTechnolgy, AD216) has several attached pressure sensors; two were used in current experiments.

Pressure Drop Tests of Metal Oxide Suspensions.

Using apparatus described earlier three kinds of metal oxide suspensions were tested: a) alumina (ALCOA, Premalox 10 SG, particle size about 0.2-0.6 μm), b) iron oxide (Atlantic Equipment Engineers, IAW MIL-1-706 TY1 C12, average particle size 0.42 μm), and c) bismuth oxide (Accumet, average particle size 0.42 μm). In order to stabilize suspension a soluble organic binder was added to water (5% wt of Arabic gum). Arabic gum (AG) is also used in a water-based preparation of Al—$Bi_2O_3$ MIC. Loading of the suspensions was chosen close to the expected concentration of the oxides in MIC preparations. In cases a) and b), 50 g of the respective oxides was mixed with 100 mL of 5% wt solution of AG and the corresponding density of the obtained slurry was 1.27 and 1.60 g/cm, Calculated volume fraction of the solids was 0.143 and 0.196 for alumina and iron oxide slurry, respectively. In the case c), 22 g of bismuth oxide was dispersed in 25 mL of the AG solution. The density of $Bi_2O_3$ slurry after mixing was 1.94 g/$cm_3$ and calculated volume fraction of solid for this density was 0.148.

Figure 3:
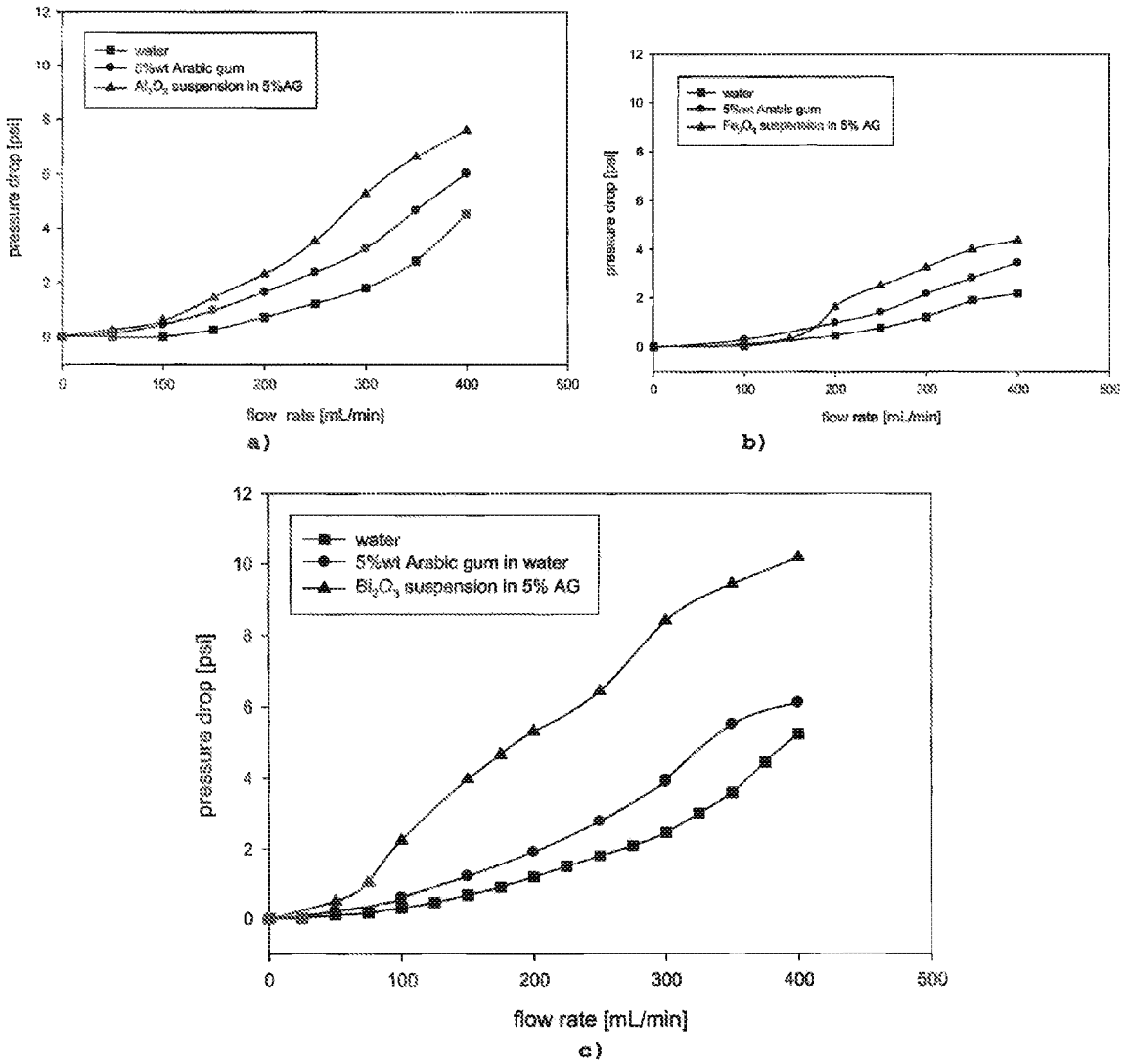
FIGS. 3*a-c* are graphs illustrating the results recorded for (a) alumina, (b) iron oxide and (c) bismuth oxide, according to embodiments of the invention.
Figure 4:
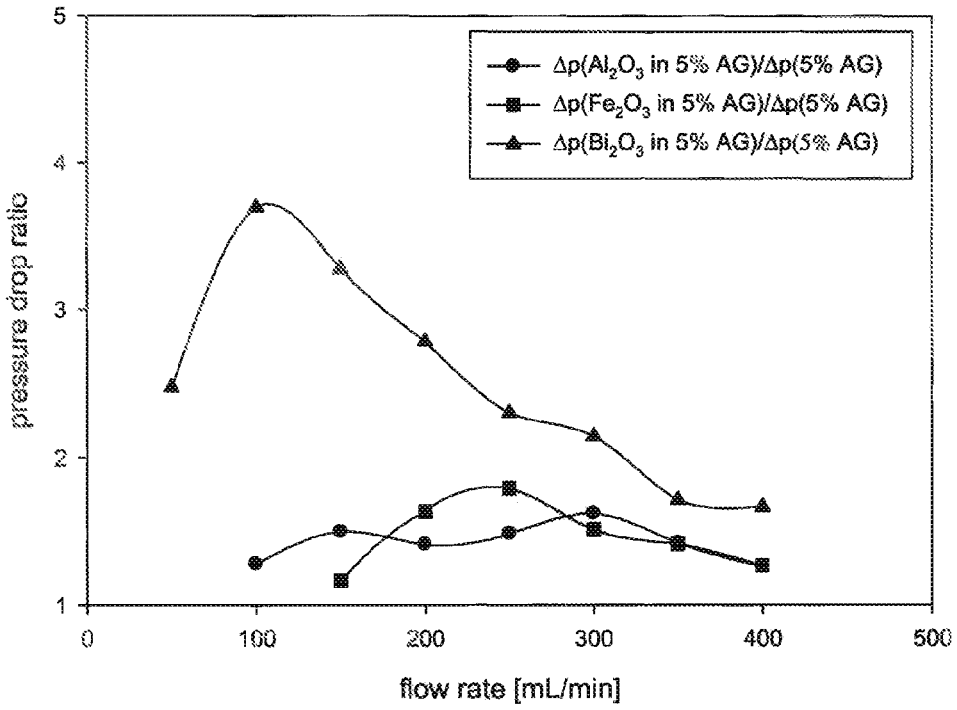
FIG. 4 is a graph illustrating pressure drop ratios ($\Delta p_{suspension}/\Delta p_{solvent}$) as a function of fluid flow rate, according to embodiments of the invention.

Each oxide suspension was passed through the in-line mixer with the increasing flow rate. Simultaneously, the pressure at entrance to the mixer was recorded. The results recorded for alumina, iron oxide and bismuth oxide are shown in FIGS. 3*a, b*, and *c*, respectively. FIGS. 3 Pressure drop on in-line mixer as a function of flow rate for metal oxides suspension in 5% wt Arabic gum solution in water: a) $Al_2O_3$, b) $Fe_2O_3$, and c) $Bi_2O_3$. The pressure at the entrance to the in-line mixer does not increase above 12 psi even at highest flow rate applied in experiments. Therefore, the flexible tubes rated at 25 psi can be safely used in the current setup. Dense slurry (bismuth oxide) experiences the highest resistance when passing mixing elements in the mixer. As expected, the pressure drop on the mixer increases with flow rate. In order to account for solvent properties (5% wt AG) the data were recalculated to show pressure drop ratio ($\Delta p_{suspension}/\Delta p_{solvent}$) as a function of the flow rate. The combined results are shown in FIG. 4. Lower density slurries (alumina, iron oxide) exhibit slight increase of the pressure drop as compared to the solvent alone. There are observed only unremarkable changes as the flow rate increases. In contrary, bismuth oxide suspension differs significantly from solvent, particularly at slow flow rate. However, the differences become less distinct at higher flow rates. The higher flow rate should be more beneficial for efficient mixing of bismuth oxide then other oxides. FIG. 4 Pressure drop ratio ($\Delta p_{suspension}/\Delta p_{solvent}$) as a function of fluid flow rate.

Mixing of Al—$Bi_2O_3$ MIC Components.

Efficiency of mixing of the Al—$Bi_2O_3$ MIC components in 5% AG solution was tested in a slightly modified system; the T-connector and link to the pressure cell was removed in order to reduce the risk of the pressure sensor contamination. A VOC vial was filled with 15 mL of $Bi_2O_3$ suspension in AG solution prepared earlier. Two components were added to this suspension: a) ammonium dihydrogen phosphate (ADP, 75 mg solid), and b) aluminum nanopowder (Al-P-80, Novacentrix). After dissolution of ADP by mixing at flow rate of 150 mL/min, the calculated amount of aluminum nanopowder was added and premixed with suspension using a vortex mixer. The resulting slurry was mixed in the in-line mixer for 30 minutes at flow rate of 300 mL. Collected slurry was used to form pellets by metering 5 μL droplets at a PFTE substrate. Left over slurry was subjected to sonication for 15 minutes and another batch of pellets was made.

The pellets dried in 25-30 minutes in the running fume hood in air with relative humidity of 30%. After further drying overnight the pellets were used to make small caliber primers using the PVU-1/A hardware. Ball drop tests conducted on these primers revealed that the mixed MIC material obtained by mixing reactants in the in-line mixer alone exhibit reduced impact sensitivity as compared to the material which was mixed and sonicated. This effect clearly indicates that effectiveness of mixing improves by the combined application of sonication and the in-line mixing.

Testing of the Slurry Dispensing System.

It was demonstrated that a tubing pump driver (Masterflex L/S-07523-60) can be used for forcing continuous flow through the in-line mixer and also for dispensing controlled quantities of liquids in a pulse mode. There is a possible setting for the dispensed volume and time lapsed between two consecutive dispensing cycles. The range of the dispensed volume is limited by the size of a tube used in the pump. In order to minimize a metered volume the smallest size of the tubing specified for Masterflex pump head (L/S 13 size) was used. With this size tube installed, the pump could meter volumes as small as 1 μL, as it is calculated and displayed by the instrument. Two dispensing volumes of interest utilized were: 254 for filling up small caliber primer cups, and 5 μL for forming small droplets, which were later dried to a pellet form.

Clear Tygon tubes were selected for testing in order to make easy to observe liquid flow within the tube. It was noticed that during dispensing 25 μL the front of the liquid (only water) moved about 50 mm along the tube (nominal ID 0.8 mm for L/S 13). Collected output of hundred pulses was weighted on an analytical balance and the average value for three measurements was 25.05±0.13 μL. However, similar tests conducted with another length of the L/S 13 Tygon tube, while mounted in the pump head at various places, yielded different average dispensed volumes: 24.3 μL, 23.8 μL, and 24.0 μL. The average standard deviation for the measurement of 10 samples was 0.13 μL. This clearly indicates that the precision of tube mounting in the pump head significantly affects the pump average output. Typically, it can be expected that the accuracy of average output of the pump will not be better than 1%, when dispensing the water volume approximately 25 μL/sample. The tested pump can provide maximum 40 doses in one minute, which is equivalent to the loading of 2400 small caliber primers/hour.

Dispensing system for testing slurry consists of a tubing pump (peristaltic pump), precise size tubing (L/S 13), about 50 cm of length and short polypropylene (PP) tubes for the connection to the slurry's container and for the feeding of the slurry into primer cups. In the later trials, a short conical end was installed at the end of the PP tube in order to make easy separation of slurry droplets from the tube. This setup was already used for the pump calibration described before.

A new system including of Al—$Bi_2O_3$ nanothermite slurry was extensively tested in the series of experiments. A standard quantity of Al—$Bi_2O_3$ MIC was prepared following water-based mixing procedure. Total volume of the mixed components was about 3 mL and this volume was equal to volume of 120 small caliber primers. However, depending on unavoidable losses during manual metering of slurry, maximum number of these primers is typically 100-110. In this test only a part (⅓) of slurry was metered using manual pipettor to fill up 30 primer cups (a standard technique used as reference), another ⅓ was dosed into 30 primer cups using peristaltic pump and rest was used to test dosing smaller quantities of slurry, 3-5 μL, directly onto the Teflon surface. The results are shown in FIGS. 5 and 6.

The average weight of MIC manually filled cups is 35.1 mg (expected value as calculated, 35.16 mg). Standard deviation (STD) for 30 samples is 0.7 mg (2%). Unexpectedly, the pump dosing is less accurate as compared to results of manual dosing. The respective data in FIG. 5 indicate larger spread of the MIC weight in primer cups; average weight is 33.4 mg with STD=2.1 mg (6%). The plot also indicates that the peristaltic pump when dosing small volumes has tendency to deliver at least two volumes, one larger than average and another smaller than average leading to an evidently bimodal distribution of samples. This characteristic is linked to the mode of operation of the peristaltic pump.

In this embodiment, the pump has four rollers and for 25 μL volume they rotate about 50 degree; therefore flow of the liquid is not smooth but is pulsating in a recurrent way. These pulsations do not exactly overlap with the start and the end of a dosing sequence, leading to unwanted "binominal" sample size of slurry. This effect is even more pronounced when rotation steps are further reduced for dosing smaller volumes. In FIG. 6, a photograph of pellets formed during dosing of a constant volume (nominally 5 μL) of Al—$Bi_2O_3$ MIC slurry is shown.

Figure 5:
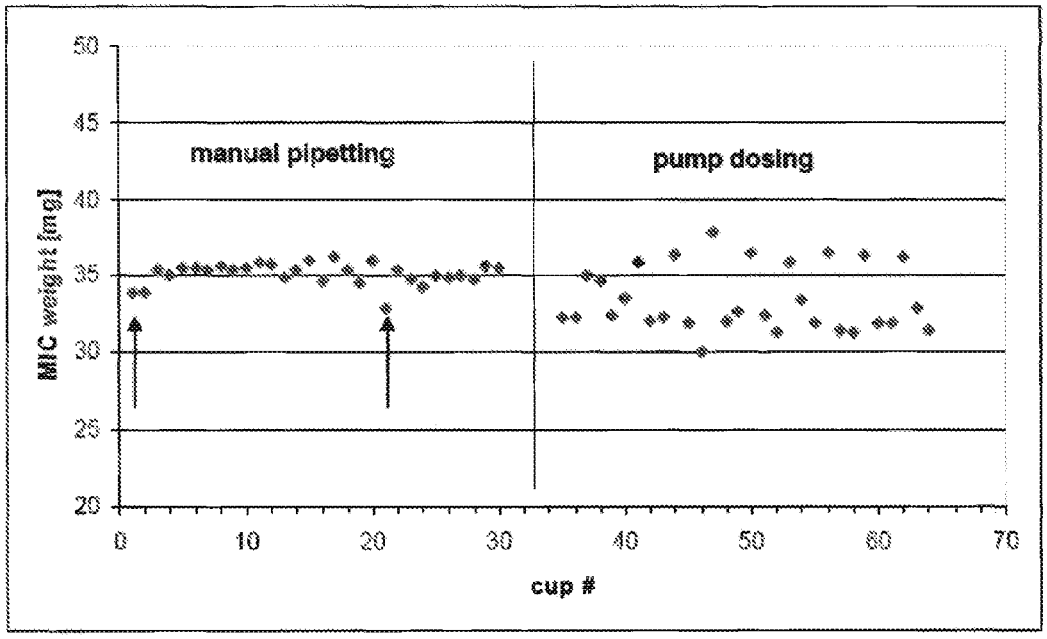
FIG. 5 is a graph illustrating weighted dry MIC composition in primer cups after metering slurry; cups #1-30 included manually pipetted MIC, and cups #35-65 included MIC dosed by the peristaltic pump, according to embodiments of the invention.
Figure 6:
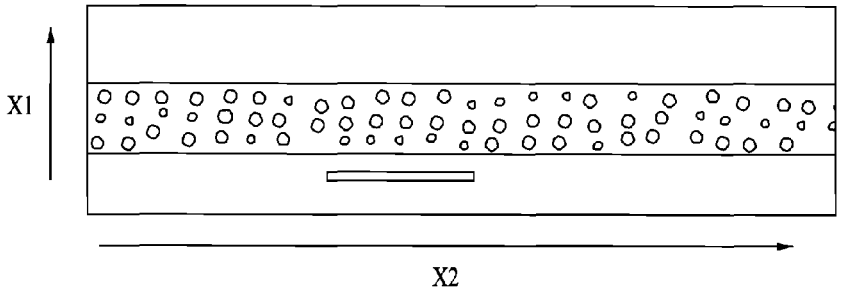
FIG. 6 is a photograph of pellets formed during dosing of a constant volume (nominally 5 μL) of Al—$Bi_2O_3$ MIC slurry, according to embodiments of the invention.

FIG. 5 shows weighted dry MIC composition in primer cups after metering slurry; cups #1-30 included manually pipetted MIC, and cups #35-65 included MIC dosed by the peristaltic pump. The arrows indicate beginning of metering with a filled-up 0.5 mL pipette. FIG. 6 is a photograph of the pellets formed by Al—$Bi_2O_3$ MIC on a Teflon strip after dosing slurry with the peristaltic pump. The sequence started at the left-bottom corner following a raster pattern; first in X1 direction then in the X2 direction. Segment above the bar shows a recurring pattern where one spot is clearly less than half-size of other two.

The performance of the tube pump can be improved by using a pump head with larger number of rotors, for example 6 or 8 instead of 4 only. Such pump heads are also constructed for multichannel operation (up to 8 channels) in a minicartridge format. The minicartridge pump head is available for the pump system (Cole-Palmer, K-07623-10) and was applied in subsequent tests. As it was demonstrated in previous tests, the tubing pump driver (Masterflex L/S model) can be used for forcing continuous flow through the apparatus and also for dispensing controlled quantities of liquids in a pulse mode. Two peristaltic pumps Masterflex L/S were arranged around the 40 mL mixing container made of hydrophobic plastic (Beckmann centrifuge vial).

One pump driven by a Masterflex console driver (Pump 1) was used to re-circulate slurry at 150 mL/min rate using L/S-16 size neoprene tubing, and the second pump, Masterflex digital driver was used for dispensing slurry (Pump 2). The dispensing pump was equipped with an eight roller minicartridge pump head (Ismatec, ColePalmer K-07623-10) in order to increase accuracy of dispensed volume. The mini cartridge operates using special Ismatec 3-stop-tubing available in various internal diameter to accommodate desired flow rate/dispensing volume. The size of the purchased 3-stop-tubing approximates the size of Masterflex L/S-13 tubing tested earlier. However, the effective dispensing volume of the 3-stop-tubing after stretching in the minicartridge holder is only a half of the volume of standard L/S-tubing; therefore, setting the dispensing driver at 50 μL would dispense 25 μL of slurry through the 3-stop-tubing. A fivefold standard quantity of Al—$Bi_2O_3$ MIC was prepared following water-based mixing procedure.

Aluminum flakes with reduced reactive aluminum content was initially mixed with bismuth trioxide nanopowder (Aldrich) in a polymer tube (40 mL, Beckmann) using vortex mixer. The slurry was then recirculated at 150 mL/min rate using Pump 1. The mixing container was placed in an ultrasound bath and slurry circulation and sonication have continued for 30 minutes. After that time a dispensing system was turned on and after priming the Pump 2 with slurry and recirculating for a few minutes the system was ready for metering of slurry into small caliber primer cups. Filling of the primer cups was conducted using Pump 2 set at dispensing mode with 2 seconds intervals between pumping pulses. One hundred (100) cups were filled with slurry and after drying they were weighted. The weight of each individual cup was then subtracted and net weight of dry MIC composition was evaluated. A photograph of the filled cups in the tray is shown in FIG. 7 whereas the MIC weight of the #1 to #100 consecutive primer cups is shown in the FIG. 8.

Figure 7:
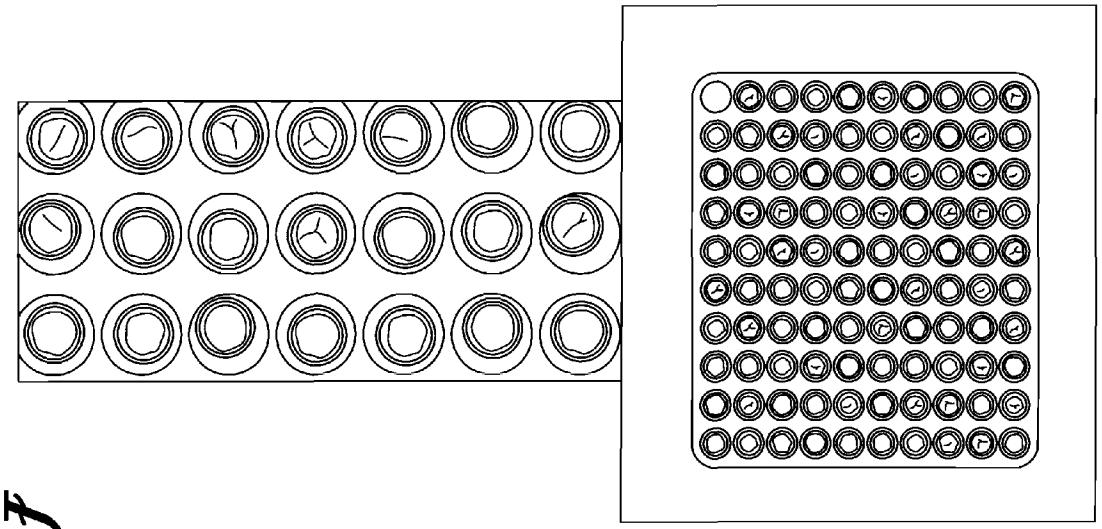
FIG. 7 is photographs of the filled cups in the tray, according to embodiments of the invention.

FIG. 7 illustrates the (top) Dried Al(flakes)-$Bi_2O_3$ MIC primer mixture in small caliber primer cups after dosing 25 μL volume of mixed slurry. The bottom-left corner in the tray include primer #1, the primer #100 (bottom-right corner) was removed for weighting; the (bottom) enlarged fragment of the view at dried primers. Shown in FIG. 7, there are visible random cracks in the material after drying. An average weight of the MIC primer in a cup was 28.8 mg as calculated from total weight of 100 primers after drying in a tray. The average of hundred weight measurements of MIC in primers is 28.7 mg with a standard deviation (STD) of 1.3 mg. The STD decreased from the reported earlier value of 2.1 mg most probably due to replacing 4 to 8 roller pump head. However, the plot in FIG. 8 has very distinctive two-level dose pattern related to the angular rotation of the Pump 2 driver shaft. Apparently, the shaft is rotating exactly 180° at driver setting of 60 μL; therefore, it is off the value set for the experiment (50 μL). In order to minimize this effect Pump 2 driver should be set at 90°, 180° or 360° rotation while compensating for dosed volume using different size of the tubing. It should be, however noticed that, the STD of 1.3 mg is in the acceptable range for the MIC primers.

Figure 8:
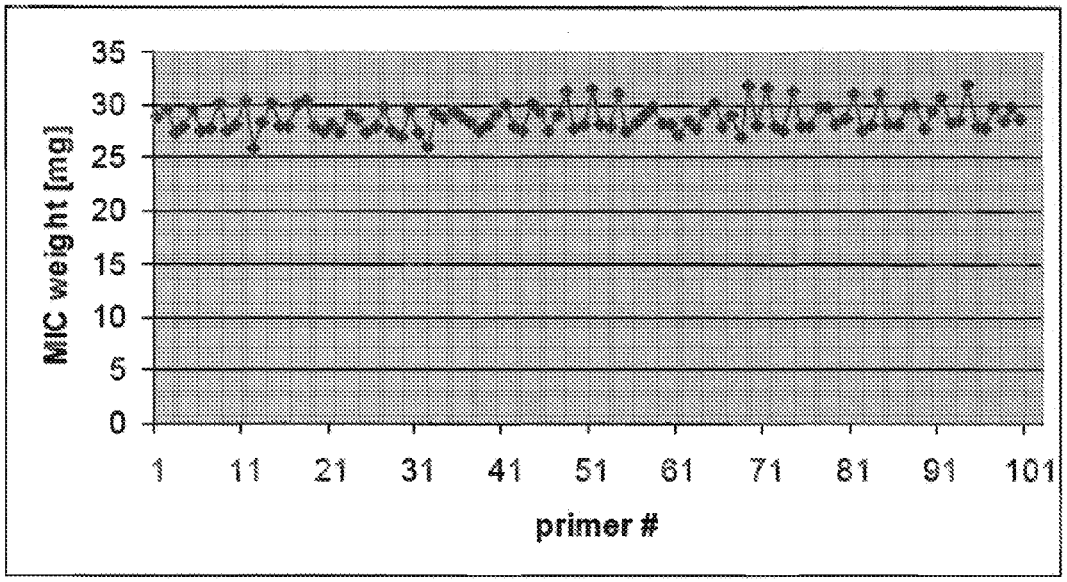
FIG. 8 is a graph illustrating the weight of Al(flakes)-$Bi_2O_3$ MIC in 100 primers after mixing and dosing MIC slurry into small caliber primer cups, according to embodiments of the invention.

FIG. 8 illustrates the weight of Al(flakes)-$Bi_3O_3$ MIC in 100 primers after mixing and dosing MIC slurry into small caliber primer cups. The average weight is 28.7 mg with standard deviation of 1.3 mg. In order to examine the effect of driver shaft rotation on smaller size dose (pellets) the series of pulsed doses of MIC slurry was deposited directly onto the Teflon surface and dried. A satisfactory result (uniform droplet volume) was observed when driver was set to rotate by 45° (about 7.5 μL of slurry), corresponding to an eight-fold symmetry axis of the rollers in the cartridge head. Ninety six (96) pellets were weighted after drying (30 minutes) and the calculated average weight was 9.4 mg with standard deviation of 0.5 mg (about 5% error). A large part of the observed STD is due to weighting inaccuracy which might be above 0.1 mg using an analytical balance.

In another set of experiments, two tubing pumps were used in the system: one for forcing continuous flow through an in-line mixer and the second one for dispensing controlled quantities of slurry. The pumps were staked one above another in order to minimize tubes length and volume of the slurry within them. Picture of the setup is shown in FIG. 9.

Figure 9:
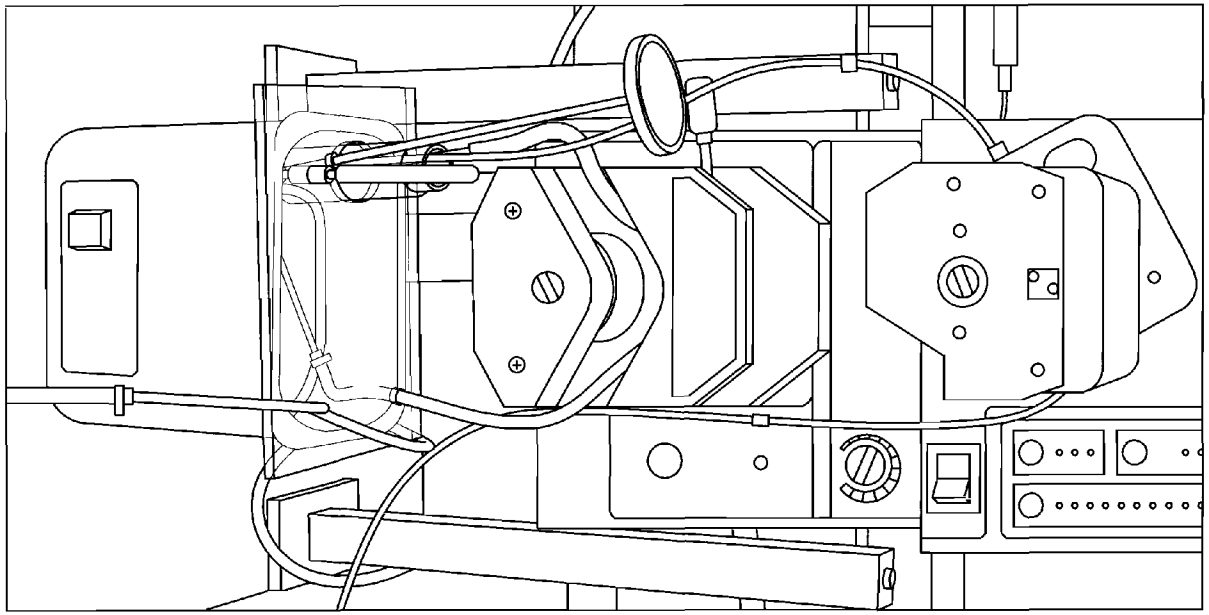
FIG. 9 is a photograph illustrating an overview of the mixing and metering system, according to embodiments of the invention.

FIG. 9 illustrates an overview of the mixing and metering system. Peristaltic pumps Masterflex L/S were arranged around the 30 mL mixing container made of glass. Use of glass was intended to reduce acoustic impedance of the container walls during applying ultrasound agitation of the slurry. In addition, silane coating was applied to make walls hydrophobic in order to repeal water. The dispensing pump, above the mixing pump as shown in FIG. 1, were equipped with an eight roller mini-cartridge pump head (Ismatec, ColePalmer K-07623-10) in order to increase accuracy of dispensed volume. A sevenfold standard quantity of Al—$Bi_2O_3$ MIC was prepared following water-based mixing procedure. Nanosize aluminum (Novacentrix, Al-80-P) was used in two tests in order to be able to assess the performance of the MIC material after mixing and drying. The components of MIC primer mixture was initially mixed in the glass vial (#8 drum) by adding aluminum powder in two steps in order to control volume of the slurry during pre-mixing. The content was wetted and premixed using a vortex mixer. The premixed slurry in mixing container was then placed in an ultrasound bath and was recirculated at 150 mL/min rate. Closer view at the mixing setup inside the ultrasound bath is shown in FIG. 10.

Figure 10:
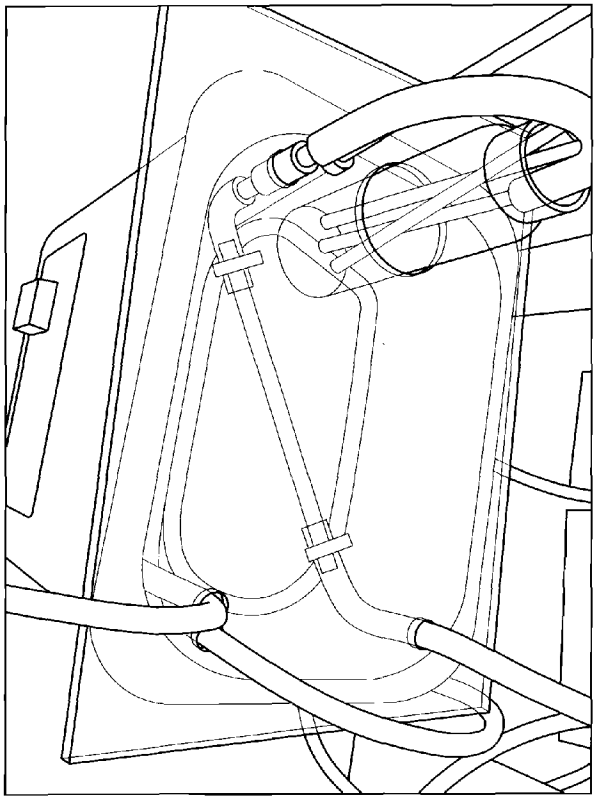
FIG. 10 is a photograph illustrating a view of mixing setup inside the ultrasound bath, according to embodiments of the invention.

FIG. 10 illustrates a view of mixing setup inside the ultrasound bath. A diagonal stainless steel tube houses an in-line mixer; copper tubing provides cooling in order to maintain 60° F. in the bath. The glass vial (empty in this picture) includes Teflon tubing contacting the slurry during mixing process; two are used in a recirculation closed loop and the third tube is for the metering pump intake. Flexible connections are made from silicone tubing. Slurry circulation and sonication continued for 30 minutes. After that time a dispensing system was turned on and after priming the pump with the slurry and re-circulating for a few minutes the system was ready for metering of the slurry into small caliber primer cups. In this experiment, the metering pump was set at the 60 μL/dose allowing using optimal full rotation of the rotors. The formulation of the slurry was slightly corrected (adding more water) in order to obtain less weight charge of the MIC into the cup. A tray of cups and tip of the dosing tube is shown in FIG. 11.

Figure 11:
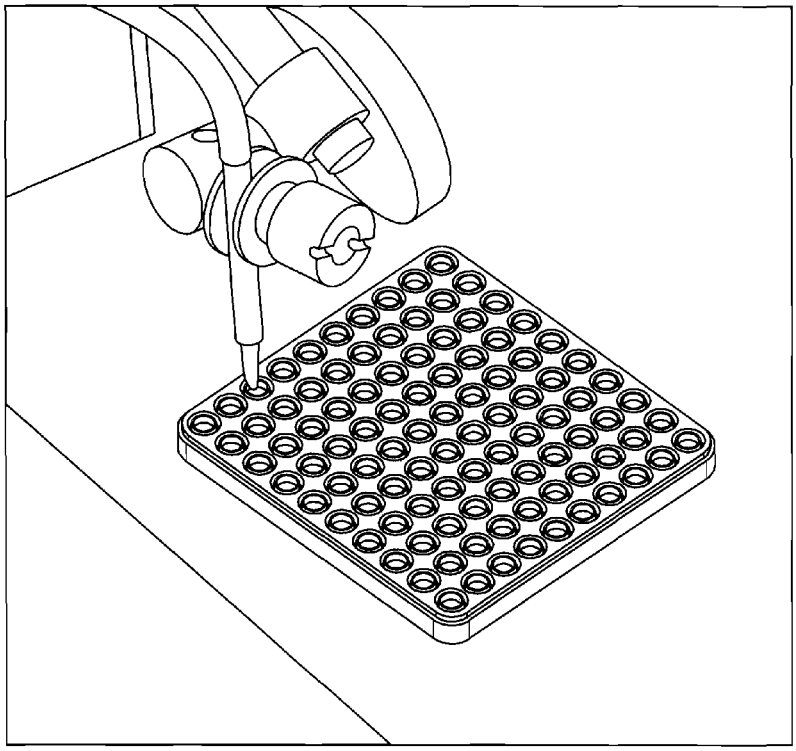
FIG. 11 is a photograph illustrating a tray of cups before filling with MIC slurry, according to embodiments of the invention.
Figure 12:
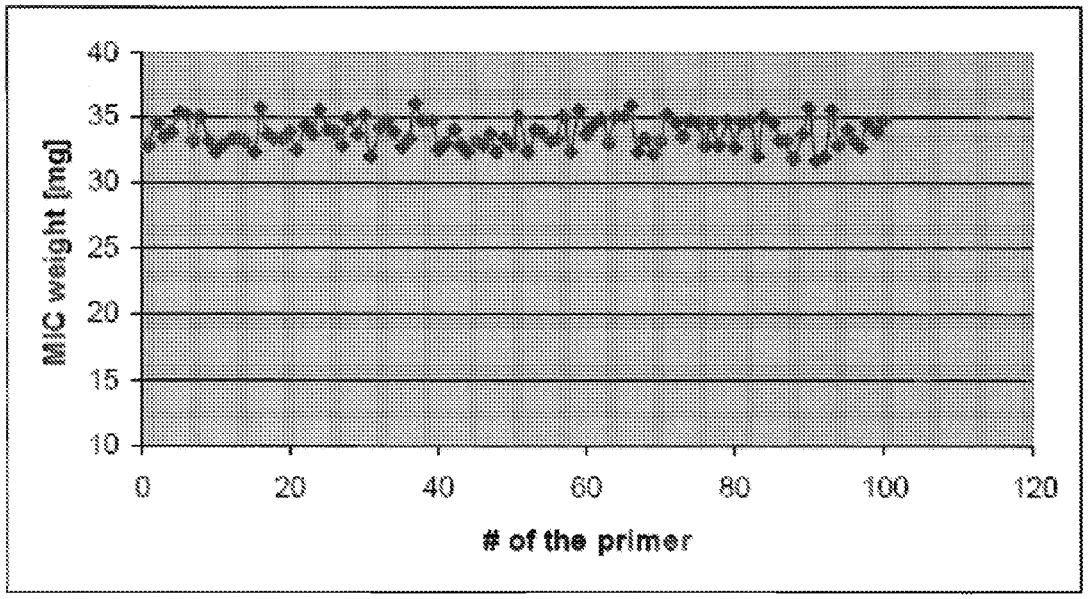
FIG. 12 is a graph illustrating the weight of Al—$Bi_2O_3$ MIC in 100 primers after mixing and dosing MIC slurry into small caliber primer cups, according to embodiments of the invention.
Figure 13:
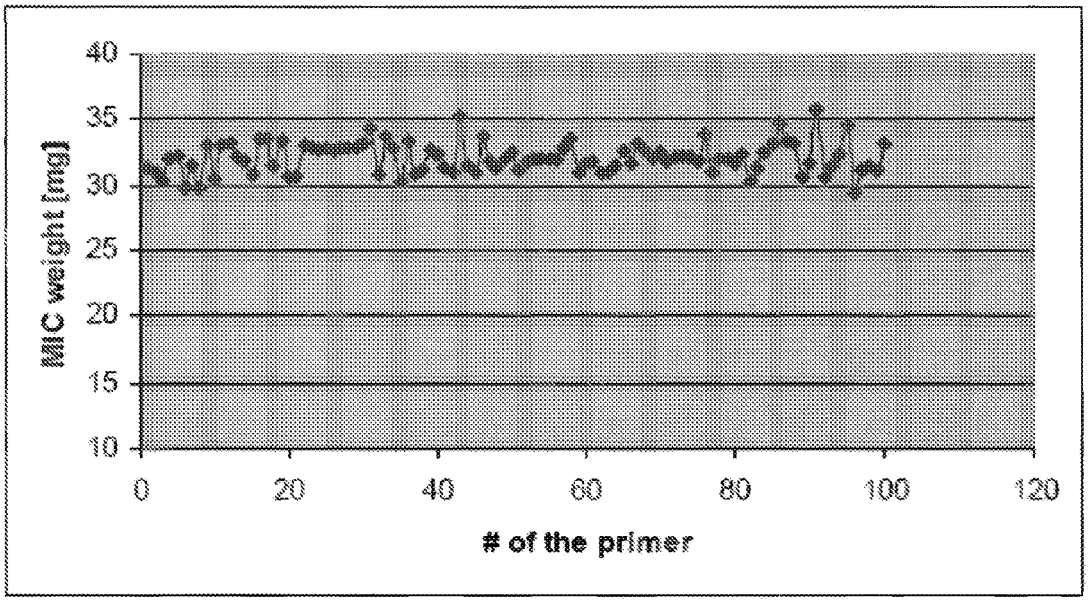
FIG. 13 is a graph ilistrating the weight of Al—$Bi_2O_3$ MIC in 100 primers after mixing and dosing MIC slurry into small caliber primer cups, according to embodiments of the invention.

FIG. 11 illustrates a tray of cups before filling with MIC slurry. In this test the tip of the dosing the system was kept motionless while the tray was moved in X-Y direction to fill each cup. Dried samples of the MIC material were weighted and analyzed using procedures reported before. The results are shown in FIGS. 12 and 13. FIG. 12 shows the weight of Al—$Bi_2O_3$ MIC in 100 primers after mixing and dosing MIC slurry into small caliber primer cups. The average weight is 33.7 mg with the standard deviation of 1.31 mg. FIG. 13 shows the weight of Al—$Bi_2O_3$ MIC in 100 primers after mixing and dosing MIC slurry into small caliber primer cups. Average weight is 32.1 mg with the standard deviation of 1.17 mg.

Although there is observed improvement in dosing accuracy due to optimal use of metering pump, the effect is not as sizable as expected. Despite alleviating all artifacts caused by pumping system and delivery—all flexible tubes were kept motionless and the delivering tip as well—the residual standard deviation is about 1 mg. This effect is due to imperfect delivery of the slurry from the end of the tubing into the cup. The uneven number of delivered drops forces the tip of the tube to be in contact with the slurry in the cup during delivery. Distribution of the slurry between the tip and the suspension in the cup when the tip is retracted from the cup is dependent on degree of wetting of the polypropylene tip by the slurry, and this is hard to control. There are some consecutive periods of equal dose (see primers #20-30 in FIG. 13) which proves that it is possible to further improve the dosing accuracy. The slurry distribution between the polypropylene tip and the suspension droplet on the Teflon surface is even more evident during making pellets. In case of small droplet volume (5 μL) sometimes a droplet would not stick to the Teflon surface, until it falls under force of its own weight, resulting in larger amount of slurry in a pellet than anticipated. This unwanted effect can be minimized by using different materials for the delivery tip made from a Teflon microtube. Drying of the slurry at the tip should also be minimized in order to keep the tip clean.

It should be however noticed that the observed standard deviation of the MIC charge in the primer cups is in the acceptable range for the primers. Sensitivity tests of the assembled primers using MIC material prepared in discussed two batches, indicated insignificant difference from each other ($h_{50\%\ probability\ to\ fire}$=5.15±0.04 inch, std=0.51±0.04 inch) and the other MIC primer batches prepared using water-based loading technique (typically $h_{50\%\ probability\ to\ fire}$=5.0 inch, std=0.6 inch). It might be concluded that the new mixing method is equivalent to formerly used smaller size batch preparation.

Preparation and Characterization of Materials for Larger Scale Testing.

Figure 14:
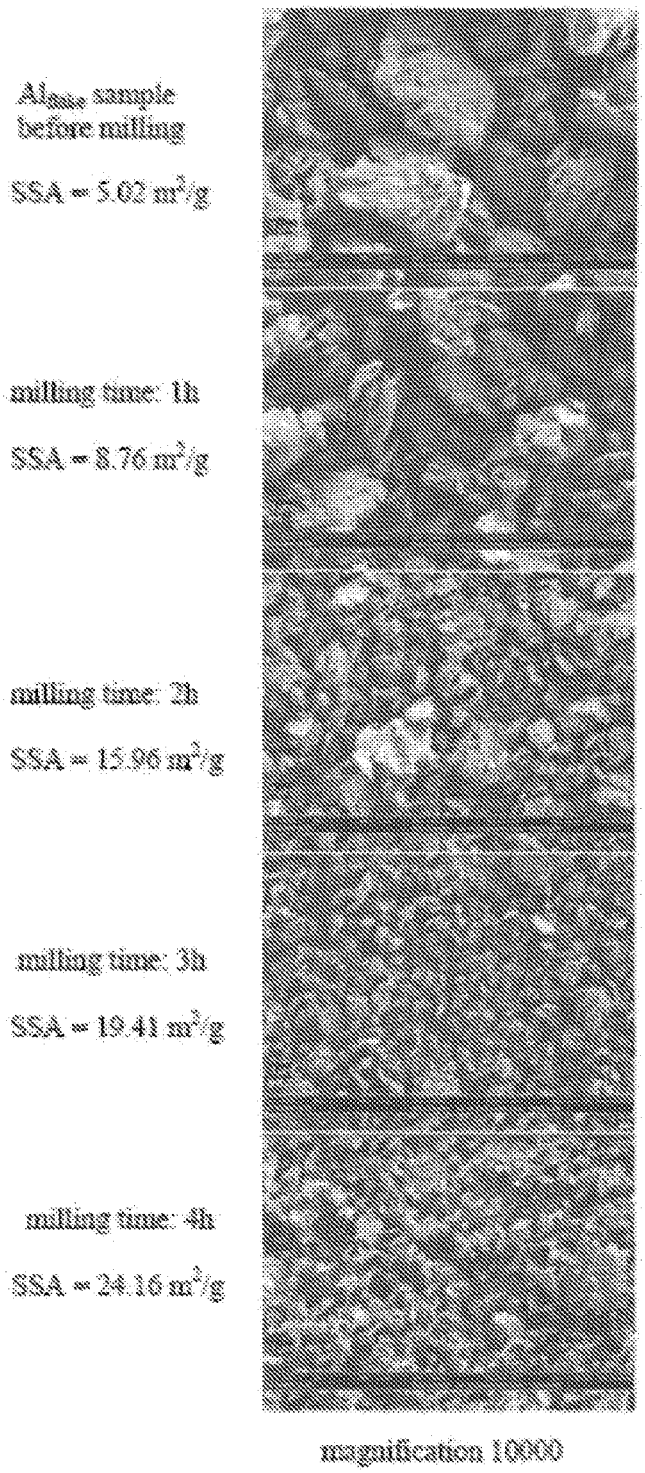
FIG. 14 is a set of micrographs illustrating the effect of milling time of aluminum, which has been tested for application in percussion primers as well as in other energetic applications, according to embodiments of the invention.

Nanosize aluminum is the most expensive component of the nanothermite systems. Recently, has been put forward effort in Innovative Materials and Processes, LLC (IMP) to substitute commercial nanoaluminum with material obtained by milling down micrometer size aluminum. During milling process, the specific surface area of the aluminum increases (up to 28 $m^2/g$). However, a prevalent morphology of the particles becomes lamellar (aluminum flakes). Typical morphologies of aluminum flakes obtained in an attritor are shown in FIG. 14. Milled aluminum has been tested for application in percussion primers as well as in other energetic applications. The milling process is still under continuous development and improvement. As a result relatively large quantities of the material produced at IMP were available. In embodiments, the milled aluminum can be treated further, if desired, in order to reduce Al—$Bi_2O_3$ MIC sensitivity, yet still it could be used as a substitute material for optimization of mixing and dosing conditions for the actual system. Significant spread of density among the oxides considered in the study and encountered in recent experiments clearly indicates that each system must be optimized separately. However, the biggest challenge in this respect is posed by the Al—$Bi_2O_3$ system.

Bismuth oxide material of appropriate size (200-400 nm) is commercially available. The milled aluminum in 12-15 g quantity was used for the next set of larger scale mixing experiment. This aluminum was tested for metal aluminum content and specific surface area (SSA); it contains 74% of reactive aluminum and has SSA=28 $m^2/g$. In comparison, currently obtained samples of milled aluminum have 80%±3% of the reactive aluminum metal and SSA=25 $m^2/g$. FIG. 14 illustrates SEM images of the Al flake samples taken during progress of attrition milling. Corresponding specific surface area (SSA) was measured using the BET technique.

In order to estimate potential sensitivity of the Al—$Bi_2O_3$ nanothermite made from the lower grade aluminum flakes a set of small caliber primers was prepared and tested in a standard ball drop test. The 50% probability of firing height for these primers was found at 6.3 inch with large STD of 1.2 inch, rendering the primers at border of the All Fire specifications. For comparison, a typical Al—$Bi_2O_3$ primer mix would produce primers which have 50% probability of firing height at 4.9 inch and STD=0.4. Although the primer mix made from lower grade aluminum flakes is not suitable for making primers it still may pose some danger if not handled properly. The material remaining after mixing/dispensing tests should be chemically neutralized.

Iron oxide used in mixing tests (Atlantic Equipment Engineers, IAW MIL-1-706 TY1 C12) was available for tests in large quantities. Mixed with low grade aluminum flakes will produce nanothermite with large energetic output but very low sensitivity to impact and ESD. Nanothermite mixtures based on this oxide and low grade aluminum flakes are relatively safe without additional treatments. Nonetheless a proper disposal procedure of used materials in mixing tests should be followed.

The essential components for larger scale mixing experiments were selected and secured in sufficient quantities. Oxidizer components were tested in the intended form. Aluminum flakes obtained from milling process are intentionally used with a lower content of reactive metal aluminum for safety reasons, nevertheless, approximating closely rheological properties of the aluminum flakes obtained in a final milling preparation.

Develop the forming and a controlled drying process of the nanothermite granules and test a safe storage of the Al—$Bi_2O_3$ granules.

Major concern during manipulation of dry MIC material is its sensitivity to the static electric discharge. Safety precaution like effective grounding of tools and operating personnel is the must in this case. The other important issue to minimize risk is to reduce quantity of a loose powder generated during typical operations and powder exposure to mechanical stress and electric discharge. The latter source of ignition has extremely low energy level for ultrafine MIC powders. Recently, electrostatic discharge experiments conducted on Al—$Bi_2O_3$ MIC system revealed that the key element in the overall ESD sensitivity is degree of consolidation of the MIC material and the ability of reaction propagation in the powder composite. It was also discovered that very minute quantity of fine MIC powder, which itself is very sensitive to the ESD, may initiate larger objects present nearby, like MIC granules or consolidated MIC material in a primer cup. Therefore, residual fine powder located at or close to such objects must be removed prior storage or use.

Concentrating our effort on handling of the Al—$Bi_2O_3$ MIC granules (about 0.5 mm diameter hemispheres) the main concern is how to handle them after drying on a Teflon plate or a conveyer. The granules are easy to remove from the Teflon surface using a grounded metal tool (for example spatula); however, granules can form some powder debris due to friction against each other. In order to prevent MIC powder formation an equal mass of fine graphite powder is added between granules assuming that less damaging contact between MIC granules will be present. Moreover, even if some MIC powder would be made during handling it will distribute within the graphite powder. ESD tests of diluted MIC powder with a conductive carbon revealed that ESD ignition of mixtures include above 20% carbon do not propagate and is quickly extinguished. Therefore, presence of conductive powder (graphite, carbon) is beneficial for reduction the risks of handling and storage of the MIC granules. Before using MIC granules in a process of preparing of pyrotechnic or ignition devices they can be easily separated out from the powders using appropriate size sieves.

Demonstrate use of the micro-mixers for other energetic nanothermites like Al—$Fe_2O_3$ in water and in anhydrous solvents.

Next set of experiments was performed to mix two different slurries. In this experiment two slurries, one consisting of Al(Al-80-P)-$Bi_2O_3$ MIC mixture and another consisting of Al(flakes)-$Fe_2O_3$ MIC mixtures were mixed in the in-line mixer with ultrasonic agitation applied. The two MIC mixtures were mixed controlling their molar fractions so that aluminum to oxidizer ratio was constant and was maintained at 18% molar excess of the fuel. After 30 minutes of mixing the material was dosed as the 5 μL droplets in order to form small pellets after drying. The MIC material appeared uniform after drying and contained 30% of $Bi_2O_3$ and 70% $Fe_2O_3$. It can be concluded that possibility of mixing and metering of different nanothermite compositions in tested device is easy to achieve and further open the possibility to combine various components in order to tune energetic output and impact sensitivity of the resulting mixed nanothermite suspension in water.

A pyrotechnic composition A1A is widely used as an ignition mix in pyrotechnic devices. The A1A composition contains zirconium and iron oxide and silica (as diatomaceous earth) as the active ingredients suspended in ethanol during mixing process. The amount of the organic solvent is controlled in order to keep solid to liquid load high and to prevent heavy and light component stratification. Presence of the diatomaceous earth (10 wt %) help this task further by increasing viscosity and tixotropic nature of the A1A suspension. The mixing apparatus was tested by preparing A1A-like suspension keeping "safe" components, iron oxide and diatomaceous earth, as directed in A1A preparation, while zirconium was substituted by the Al(flakes) and ethanol was replaced by less volatile isopropyl alcohol.

Figure 15:
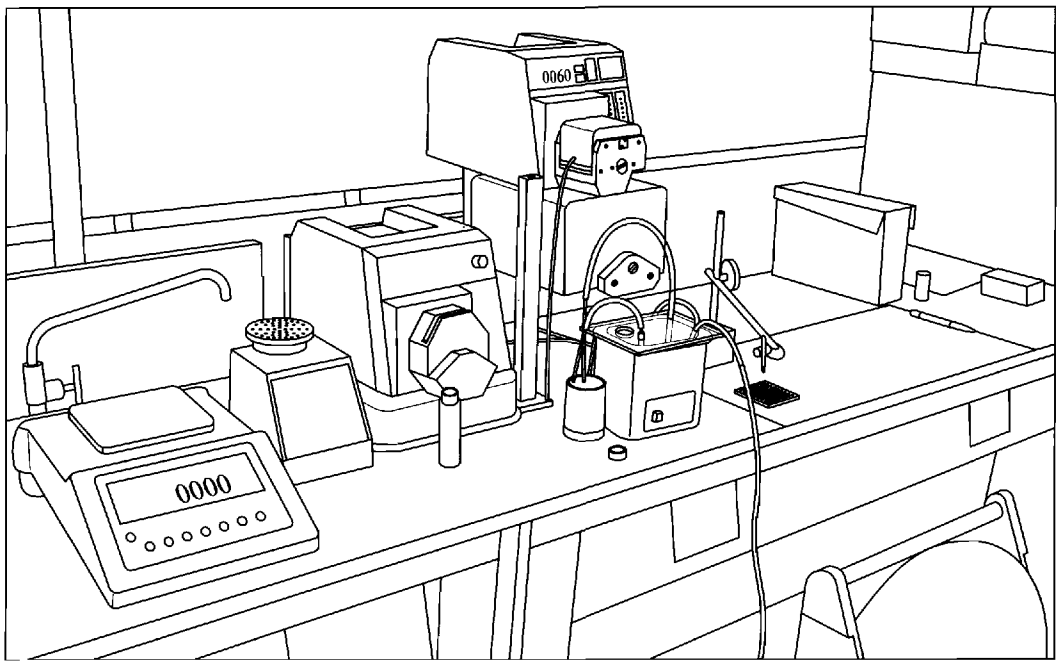
FIG. 15 is a photograph illustrating a view at mixing apparatus, premixing pump and other auxiliary instruments used in preparation of Al—$Fe_2O$, nanothermite in presence of diatomaceous earth suspended in isopropyl alcohol (A1A-like composition), according to embodiments of the invention.

Expecting very viscous suspension to deal with, it was necessary to set up additional circulation pump in order to premix the nanothermite components before feeding slurry into the in-line mixer. Insufficiently dispersed iron oxide and diatomaceous earth introduced into the inline mixer would inevitably clog the system. Powder components were separately weighted (2 g diatomaceous earth (DE), 5 g iron oxide, 3 g aluminum flakes) and 20 mL of isopropyl alcohol was measured by volume. Diatomaceous earth is first mixed with solvent and then iron oxide is added to the suspension. The slurry is mixed using a vortex mixer. After homogenizing suspension, as viewed as color of the suspension become uniform, small portions of aluminum flakes is added and mixing continues in order to wet the aluminum powder. After combining all components, the slurry in a vial is attached into a premixing pump. The premixing pump is shown in FIG. 15. It is a peristaltic pump equipped with standard silicone tubing with the PFTE extensions inserted into the mixing vial. There is no restriction on the path in order to minimize flow resistance, but to maintain vigorous recirculation flow. The premixing at rate of 30-150 ml/min continued for 15 minutes and homogenized slurry was pumped out of the premixing system into a glass vial (#8 drum size) which later served as a mixing vessel.

Figure 16:
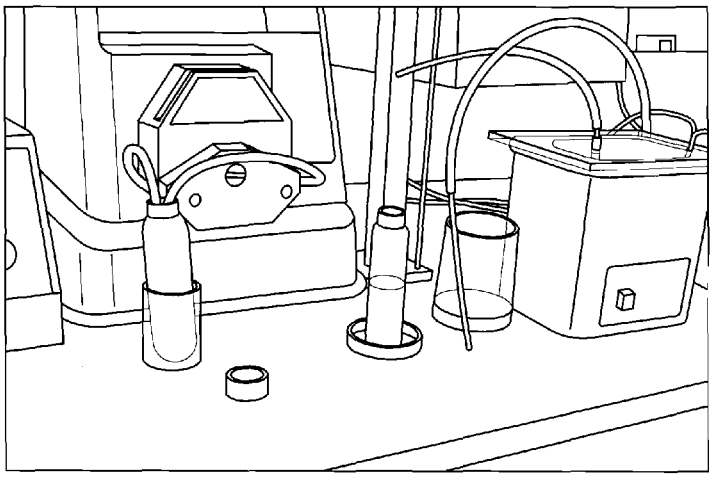
FIG. 16 is a photograph of the premixed material transferred into glass vial, according to embodiments of the invention.

FIG. 15 illustrates a view at mixing apparatus, premixing pump and other auxiliary instruments used in preparation of Al—$Fe_2O_3$ nanothermite in presence of diatomaceous earth suspended in isopropyl alcohol (A1A-like composition). A photograph of the premixed material transferred into glass vial is shown in FIG. 16. Transfer of dense and viscous slurry suffers losses due to residual coverage on walls of the premixing vessel, the tubing, and the most of all due to incomplete removal of the slurry from the premixing system. Out of 25.7 g total weight of the mixture the weight of transferred slurry was 19.6 g, the slurry left in premixing vessel weighted 3.1 g and that left in the tubing weighted 1.8 g. About one gram was not accounted for which may also include loss due to evaporation of the solvent.

Figure 17A:
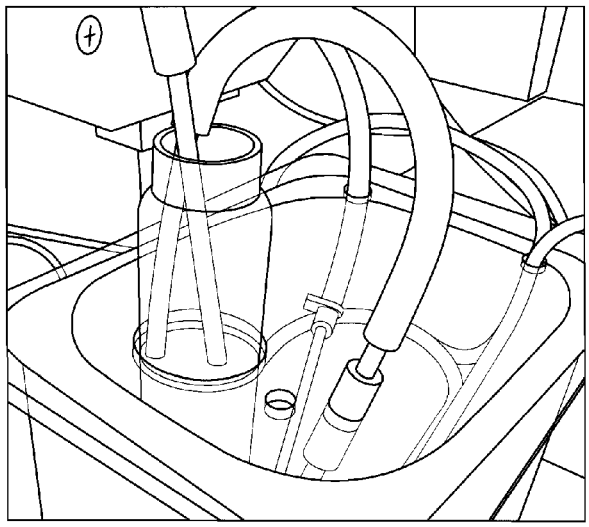
FIGS. 17*a-b* are photographs illustrating the Al—$Fe_2O_3$—$SiO_2$ slurry in a glass vial before mixing (left) and after mixing pump started (right), according to embodiments of the invention.
Figure 17B:
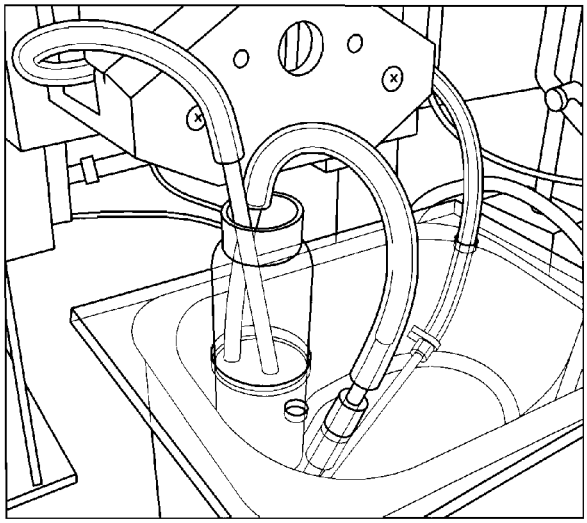

FIG. 16 illustrates a close-up view on the premixed Al—$Fe_2O_3$ slurry after transferring the content of premixing vial (left) into the glass vial (right). Final mixing and sonication of the slurry in the glass vial was carried out in a mixer as shown in FIGS. 17A and B. FIGS. 17A and B illustrates the Al—$Fe_2O_3$—$SiO_2$ slurry in a glass vial before mixing (left) and after mixing pump started (right). The Al—$Fe_2O_3$—$SiO_2$ slurry after 30 minutes mixing and sonication was released into a drying pan and allowed to dry in air. The slurry left in the mixing container and tubes was weighted in order to estimate amount of material trapped within the mixing system. It was found that another 3.3 g of slurry resided in the mixing system. Inability to pump out all material from the premixing and mixing systems led to recovery of only ⅔ of the solids after evaporating off the solvent from the collected slurry.

Mixing system tested with pure water exhibit only about 0.5 g water left in the tubing and similar amount left in the reservoir. In this case, full advantage of hydrophobicity of the tubing and the container walls can be exercised. Less viscous and more hydrophilic suspensions has tendency not to adhere and reside in the tubing and reservoir of the mixer. The residual liquid in the mixing system is less significant when larger volumes of the slurry are involved (there are, however, limits for that increase) and when mixing system is operating without need of the discharging all mixed slurry. The latter condition can be easily fulfilled when nanothermite slurry is dispersed in a truly inert solvent.

Demonstrate Use of the Micro-Mixers for Preparation of Al—$MoO_3$ in Anhydrous Solvents.

Aluminum-molybdenum oxide MIC is typically prepared in an inert solvent, for example n-hexane. However, hydrocarbons are not miscible with water and would separate from NaOH solution in water when it is applied for deactivation of aluminum in MIC slurry after the experiments. Therefore, anhydrous acetone-isopropyl alcohol (IPA) solvent was used, which is miscible with water solution; in order to secure full extend of reaction of aluminum metal with water. In addition, this solvent is suitable to dissolve nitrocellulose as a binder in the formulation. The composition of the Al—$MoO_3$ MIC was following: 1). 2.475 g $MoO_3$ was suspended in 6 g of 1:1 by volume solution of acetone in isopropyl alcohol; 2). 2.025 g aluminum flakes (milled Feb. 4, 2008) was suspended in 6 g of 1:1 by volume solution of acetone in isopropyl alcohol; 3). 3.000 mL nitrocellulose solution was prepared in 1:1 by volume mixture of acetone in isopropyl alcohol. This solution included 89 mg nitrocellulose in 1 mL.

Figure 18:
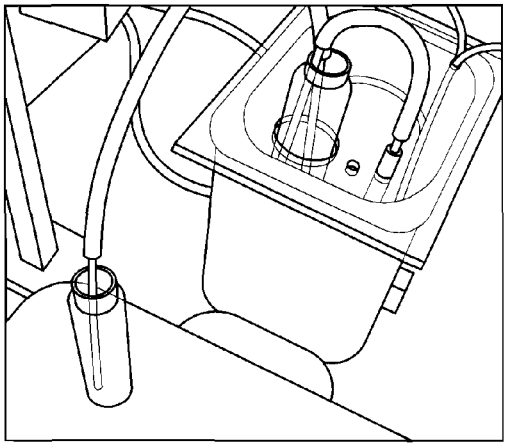
FIG. 18 is a photograph illustrating a suspension of $MoO_3$ suspended in acetone and isopropyl alcohol which was pumped into the mixing vial using circulation pump of the mixer, according to embodiments of the invention.
Figure 19:
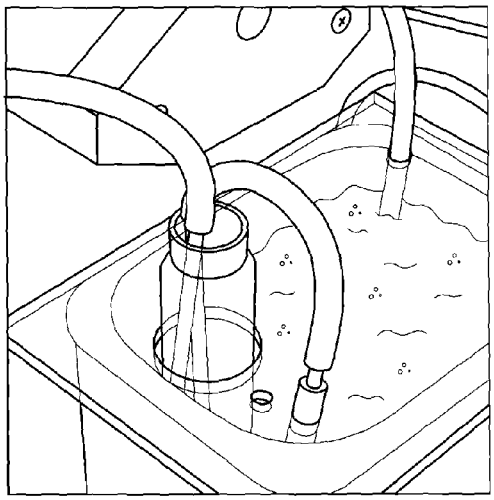
FIG. 19 is a photograph of a circulation pump which was set up at 120 ml/min flow and the ultrasound bath was turned on for thirty minutes and illustrates aluminum flakes suspended in acetone/IPA solution, according to embodiments of the invention.

Suspension prepared in step 1 was pumped into the mixing vial using circulation pump of the mixer (FIG. 18). Later, suspension of the aluminum flakes was transferred into a mixing vial. From this moment the circulation pump was set up at 120 ml/min flow and the ultrasound bath was turned on for thirty minutes (FIG. 19). Dry molybdenum trioxide nanopowder was placed in a mixing vial, the same vial with $MoO_3$ nanopowder was premixed with an acetone/isopropyl alcohol 1:1 mixture (by volume). FIG. 19 shows $MoO_3$ suspension in acetone/IPA solution being transferred into a mixing vial (left). After mixing for half of the time (about 15 minutes after starting mixing) the nitrocellulose solution prepared in step 3 was added into the mixing vial. The mixing continued until 30 minutes lapsed. After that time circulation speed was reduced to about 40 ml/min (⅓ of full speed) and an intake tube and dispensing tip were inserted into the mixing vial. Then, a metering pump was turned on in order to prime the metering pump at constant flow of about 10 ml/min. When a steady stream of slurry was flowing out of the dispensing tip the mode of the metering pump was changed to dosing of predetermined (12 μL) volume at rate 1 dose/second and pump was stopped for several seconds in order to allow alignment of the dosing tip over the receiving Teflon strips.

FIG. 19 illustrates aluminum flakes suspended in acetone/IPA solution mixed with $MoO_3$ suspension in the mixing vessel. With a closed circulation loop, aluminum and $MoO_3$ nanoparticles were mixed using simultaneously an in-line mixer and ultrasonic waves After 30 minutes of mixing a dosing pump intake tube (shown by an arrow in picture on right) was inserted into the mixing vial. A multiple 25 μL dose of the Al—$MoO_3$ slurry was dispensed every second onto a Teflon tapes (shown on the right side of the picture) and dried.

Figure 20:
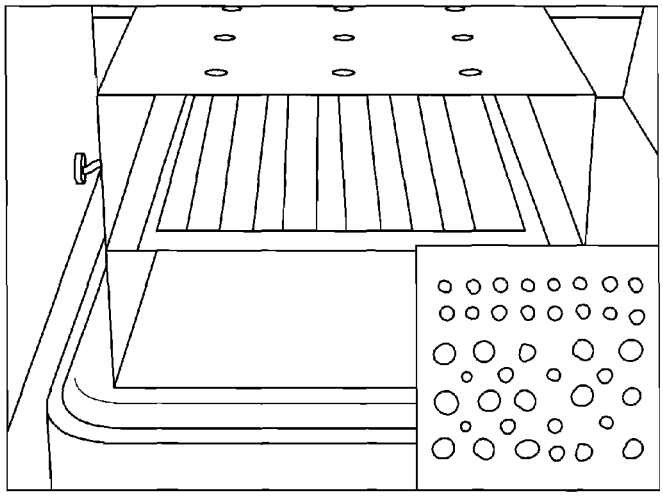
FIG. 20 is a photograph illustrating a two-shelf drying channel placed in the hood, according to embodiments of the invention.

After restarting the metering pump small droplets of the MIC slurry were placed manually at the surface of Teflon strips. Shortly after covering available space on Teflon the droplets were placed on the shelf for drying in the hood (FIG. 20). FIG. 20 illustrates a photograph of two-shelf drying channel placed in the hood. Air flow in the channels is 1-2 m/s when hood is running. Inset shows Al-flake-$MoO_3$ pellets after drying. The MIC pellets were dried and removed from the Teflon strips after 30 minutes. An image of the dried pellets of two sizes corresponding to 12 and 6 μL dose is shown in an inset in FIG. 20. The pellets of the same dose size are not uniform, but they are of similar weight. The difference in shape is caused by rate of solvent evaporation and ability of wetting Teflon by the slurry. The pellets are flat indicating that slurry wets substrate well before solvent dries out. In contrast the pellets made from water suspension of Al—$Fe_2O_3$—

Figure 21:
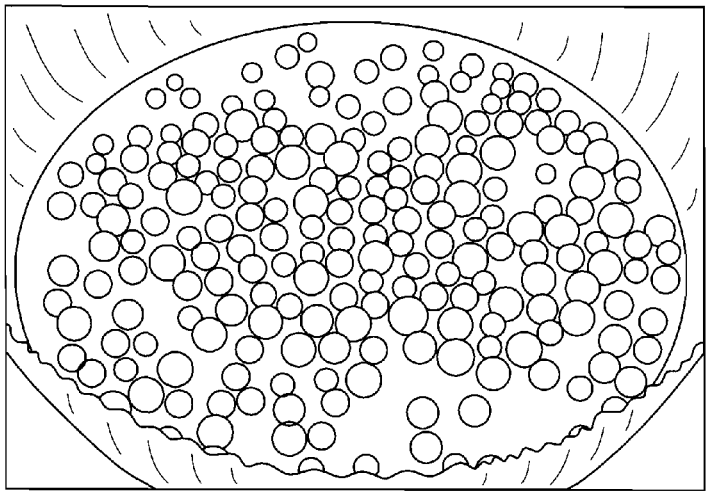
FIG. 21 is a photograph illustrating the Al—$Fe_2O_3$—$Bi_2O_3$ pellets obtained by drying water suspension droplets on Teflon surface, according to embodiments of the invention.

$Bi_2O_3$ system by the same method resulted in much more uniform almost spherical shape (see FIG. 21).

FIG. 21 illustrates a photograph of the Al—$Fe_2O_3$—$Bi_2O_3$ pellets obtained by drying water suspension droplets on Teflon surface. Al flakes-$MoO_3$ pellets were used to assembly small caliber percussion primers in order to assess MIC impact sensitivity. Neyer statistical testing and analysis was used to evaluate 50% probability height ($h_{50\%}$) and its standard deviation (std) for the ball drop data. The $h_{50\%}$=6.22 inch and std=0.42 inch recorded for Al flakes-$MoO_3$ MIC is evidently lower than that expected for corresponding MIC primer mixture made from nanoaluminum with higher active aluminum content in hexane. Nonetheless, Al flakes-$MoO_3$ MIC prepared in a semi-continue mixing apparatus using organic anhydrous solvent can be qualified as passing impact sensitivity tests required for small caliber primers (All fire<25 inch*oz and No fire>3.8 inch*oz). The impact sensitivity reduction can be related to reduced amount of the active metal aluminum content in the aluminum flakes batch used throughout the experiments.

In conclusion, off-shelf tubing pumps (Masterflex peristaltic pumps) were extensively tested in a mixing and metering system of the nanthermite in water as well as in anhydrous organic solvents slurries. Nanothermite systems based on aluminum nanoflakes—oxides (—$Bi_2O_3$, —$Bi_2O_3$/$Fe_2O_3$, —$Fe_2O_3$/$SiO_2$, and —$MoO_3$) suspended in a solvent varies in viscosity and tixotropic properties. Nonetheless, combining simultaneous action of the in-line mixer and the ultrasound field led to very effective mixing of nano-particles in the slurry for each system. Impact sensitivity tests made on standard MIC primer mixtures (Al—$Bi_2O_3$) indicated that new mixing method is equivalent to formerly used small-size batch preparation. Application of microtube heads in a tubing pump allowed for precise small volume metering of nanothermite slurry into primer cup (25 μL) as well as for the formation of equal mass pellets (7.5 μL). The new method of mixing of the nanothermite components in water suspension can be easily scaled up from current minimal volume of 30 mL to 300 mL, using the same pump system, by increasing size of the mixing vessel and tubing diameter.

Modified procedure for water-based preparation of the Al—$Bi_2O_3$ MIC with ADP and Arabic gum. This procedure will yield about 20% excess of Al—$Bi_2O_3$ MIC mixture in water in order to conveniently refill syringe and fill up 100 small caliber primer cups. This formulation has Arabic gum as a binder.

1) Weight into a container (a vial ~½" diameter) 3600 mg of bismuth trioxide nanopowder (Accumet, SSA=1.62 $m_2$/g).

2) Add 360 μL 5 wt % solution of ammonium dihydrogen phosphate in water and add 840 μL of 5 wt % solution of Arabic gum in water. Let solution soak the oxide powder, stir in a variable speed vortex.

3) Weight into the container 636 mg of aluminum nanopowder (Nanotechnology, Al-80-P, SSA=21.7 mig).

4) Add 1200 μL of 5 wt % solution of Arabic gum in water.

5) Thoroughly mix components on the variable speed vortex until suspension will look homogeneous and appear liquid.

6) Place container in an ultrasound bath and mix for 10-15 minutes. Use vortex stirrer if necessary to obtain homogeneous slurry.

7) Fill up repeater pipette (Eppendorf Repeater Plus Pipette) with a slurry, set volume to be dispensed (25 μL for small caliber cups) and proceed with metering MIC slurry into the cups (expected weight of the MIC after drying is ~35 mg/cup).

8) Collect filled cups and dry under continuous flow of dry air (about 30% RH) at ambient temperature (24° C.); this may take 2-3 hrs under these conditions. Check weight of the selected cups for controlling water removal.

9) After 2-3 hours drying leave the pre-dried primers at ambient conditions over night. Check if the primers attain constant weight indicating effective removal of water.

10) Consolidation and insertion of the anvil follow the same, typical steps for all MIC primers.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A process of making thermite composites, comprising:

providing a fuel-based slurry and at least one oxidizer-based slurry;

formulating combination of fuel-based slurry and oxidizer-based slurry in a solvent to a desired energetic dose depending on nanocomposites' use;

circulating said fuel-based slurry/said oxidizer-based slurry combination in a mixing device operating semi-continuously during mixing and dispensing cycles forming a homogeneous mixed slurry, wherein said step of semi continuous mixing utilizes an in-line mixer capable of recirculation of said desired slurry formulation;

agitating ultrasonically or by high shear rate mixers said mixed slurry; and drying of said mixed slurry forming compact structures.

2. The process according to claim 1, wherein said mixing process being a water-based mixing process.

3. The process according to claim 1, wherein said step of forming compact structures comprises forming pellets or granules.

4. The process according to claim 1, wherein said step of formulating combination of fuel-based slurry and oxidizer-based slurry to desired energetic dose depending on said nanocomposites' use comprises dosing said slurry combination to produce energetic nanocomposites for one of the applications selected from the group consisting of primer cups, coatings, percussion primers, electric primers, and low energy initiators.

5. The process according to claim 1, wherein said at least one fuel-oxidizer-based slurry comprises a metal and/or metal alloy.

6. The process according to claim 5, wherein said metal and/or metal ally comprises Al or Al-metal.

7. The process according to claim 6, wherein said at least one fuel-oxidizer-based slurry comprises at least one of Al—$Fe_2O_3$, Al—$Bi_2O_3$, Al—$MoO_3$, Al—$WO_3$, Al—CuO, Al—$Bi_2O_3/Fe_2O_3$, Al—$Fe_2O_3/SiO_2$, and any combination thereof.

8. The process according to claim 1, further comprising the step of mixing said oxidizer-based slurry in a least one solvent.

9. The process according to claim 8, wherein said solvent comprises water or anhydrous solvents from the group consisting of hexane, acetone, isopropyl alcohol, and any combination thereof.

10. The process according to claim 9, further comprising the step of mixing a second oxidizer-based slurry to said oxidizer-based slurry/solvent.

11. The process according to claim 1, wherein said steps of circulating said fuel-based slurry/said oxidizer-based slurry combination in a mixing device operating continuously during mixing and dispensing cycles resulting in a mixed slurry; and agitating ultrasonically said mixed slurry can be simultaneously for a specified time depending on desired utility.

12. The process according to claim 1, wherein said composites comprises nanosized particles being in the form of nanopowders and/or nanoflakes.

13. The process according to claim 1, wherein said slurry mixture further comprising the step of adding a binder.

14. The process according to claim 1, further comprising at least one energetic additive.

* * * * *